United States Patent [19]

Swan et al.

[11] 4,445,502

[45] May 1, 1984

[54] SAFETY RESTRAINT SYSTEM AND INERTIAL REEL THEREFOR

[76] Inventors: Algernon G. Swan, 2533 Woodlake Dr., Albilene, Tex. 79606; Eugene A. Stead, Jr., Rte. 1, Box 135, Clarksville, Va. 23927; William P. Thompson, 6315 Scatterfield Rd., Anderson, Ind. 46015; David P. Colvin, Rte. 5, Box 67, Apex, N.C. 27502

[21] Appl. No.: 370,468

[22] Filed: Apr. 21, 1982

Related U.S. Application Data

[60] Continuation-in-part of Ser. No. 216,559, Dec. 15, 1980, abandoned, which is a division of Ser. No. 92,568, Nov. 8, 1979, Pat. No. 4,256,098.

[51] Int. Cl.[3] ..... A61H 1/02

[52] U.S. Cl. ..... 128/25 R; 104/62; 104/89; 188/293

[58] Field of Search ..... 128/24 R, 25 R, 25 B; 5/81 R, 81 B, 83, 87–89; 242/75.53, 99, 107; 188/293, 180, 307; 254/377; 182/233, 238; 104/62, 67, 89, 91, 93; 294/78, 81 SF, 81 R, 83 HA, 115

[56] References Cited

U.S. PATENT DOCUMENTS

| | | | |
|---|---|---|---|
| 2,358,825 | 9/1944 | Pribula | 188/293 |
| 2,807,335 | 9/1957 | Beaumont et al. | 188/293 |
| 2,871,915 | 2/1959 | Hogan | 128/25 R |
| 3,001,634 | 9/1961 | Bauder | 104/89 X |
| 3,034,604 | 5/1962 | Holmes | 188/293 |
| 3,780,663 | 12/1973 | Pettit | 128/25 R X |
| 3,985,082 | 10/1976 | Barac | 128/25 R |
| 4,018,423 | 4/1977 | Belew | 242/99 X |
| 4,256,098 | 3/1981 | Swan et al. | 128/25 R X |

*Primary Examiner*—Richard J. Apley
*Assistant Examiner*—David J. Brown
*Attorney, Agent, or Firm*—Shlesinger, Fitzsimmons & Shlesinger

[57] ABSTRACT

In this system an inertial reel is mounted beneath a platform, which is carried by a pair of trucks that roll along an overhead rail which is fastened to the ceiling of a hospital corridor or the like. Two, adjustable, rigid handles project downwardly from the platform to be gripped by a patient, who in turn is adapted to be connected by a harness to a retractable tether or cord, which extends downwardly from the inertial reel behind the patient. While gripping the handles the patient may walk beneath the overhead rail, thereby causing the trucks to roll on the rail and to maintain the platform above the patient. If the patient should suddenly stumble or fall, an hydraulic mechanism in the reel automatically brakes the trucks against movement on the rail and resists withdrawal of the cord from the reel, so that the patient is slowly lowered to the floor. The platform is rotatable by the patient 180° relative to the overhead trucks so as to enable the patient to reverse his or her direction of movement. Also the hydraulic mechanism includes a frustum-shaped reel which causes the resistance to the withdrawal of the cord to be decreased slightly as the knees and/or hands of a falling patient reach the floor.

11 Claims, 5 Drawing Figures

SAFETY RESTRAINT SYSTEM AND INERTIAL REEL THEREFOR

RELATED APPLICATION

This application is a continuation-in-part of our pending U.S. application Serial No. 216,559, now abandoned filed Dec. 15, 1980 for Safety Restraint System For Ambulatory Patients, which application in turn was a division of our U.S. application Ser. No. 092,568, which was filed Nov. 8, 1979, and which issued on Mar. 17, 1981 as U.S. Pat. No. 4,256,098.

BACKGROUND OF THE INVENTION

This invention relates to an improved safety restraint system or mechanism particularly suitable for use by ambulatory patients, and to an improved inertial reel suitable for use with such system.

In the restraint system disclosed in our above-noted U.S. Pat. No. 4,256,098, a patient is adapted to be supported by a flexible cord or tether, the upper end of which is wound onto a spring-loaded inertial reel that is guided for rolling movement on a rail that is imbedded in the ceiling of a nursing home, or the like. The lower end of the cord is attached by a yoke either to a pair of hook-shaped members which engage beneath the armpits of a patient, or to the shoulders of a vest-like garment which is worn by the patient. In either case the attached patient is free to walk beneath the overhead rail with his or her forward motion tending to maintain a slight tension in the cord, and to draw the inertial reel along the rail so that the reel remains, in essence, above the head of the associated patient. If while walking the patient should stumble or fall, the attached cord is unwound suddenly from the reel, thereby causing an inertial mechanism in the reel automatically to increase the resistance against the withdrawal of the cord, which therefore causes the attached patent to be lowered slowly to the floor.

In the above-described system the cord is attached to the patient by an overhead yoke-like member, so that the patient's hands and arms are free. While this is sometimes advantageous for the less than critically infirmed, it has the disadvantage that the patient has nothing to hold onto to help steady his or herself while walking. Moreover, while the overhead reel is free to roll horizontally in response to the forward or rearward motion of the attached patient, this sometimes may be a disadvantage because the reel is not always in the same vertical position relative to the patient. Also, such prior system did not include any means for braking the horizontal movement of the reel on the associated rail, nor did it embody any means for releasing the pressure in its hydraulically-operated inertial reel selectively to allow freedom of movement of the attached patient at certain times.

It is an object of this invention, therefore, to provide an improved safety restraint system of the type described which is designed to form a far more stable support for ambulatory patients than prior such systems.

Another object of this invention is to provide an improved safety restraint system of the type described which includes, in addition to the flexible, patient-supporting tether or cord, a rigid, adjustable hand grip mechanism for moving the overhead inertial reel horizontally along the associated support rail, and for rotating the reel about a vertical axis to enable reversal of the horizontal movement of the reel and associated support mechanism, when desired.

Still another object of this invention is to provide a restraint system of the type described and an improved inertial reel, which is connected to a braking device that automatically stops horizontal movement of the reel when the attached patient accidentally falls.

Other objects of the invention will be apparent hereinafter from the specification and from the recital of the appended claims, particularly when read in conjunction with the accompanying drawings.

THE DRAWINGS

DETAILED DESCRIPTION OF THE PREFERRED EMBODIMENTS

Figure 1:
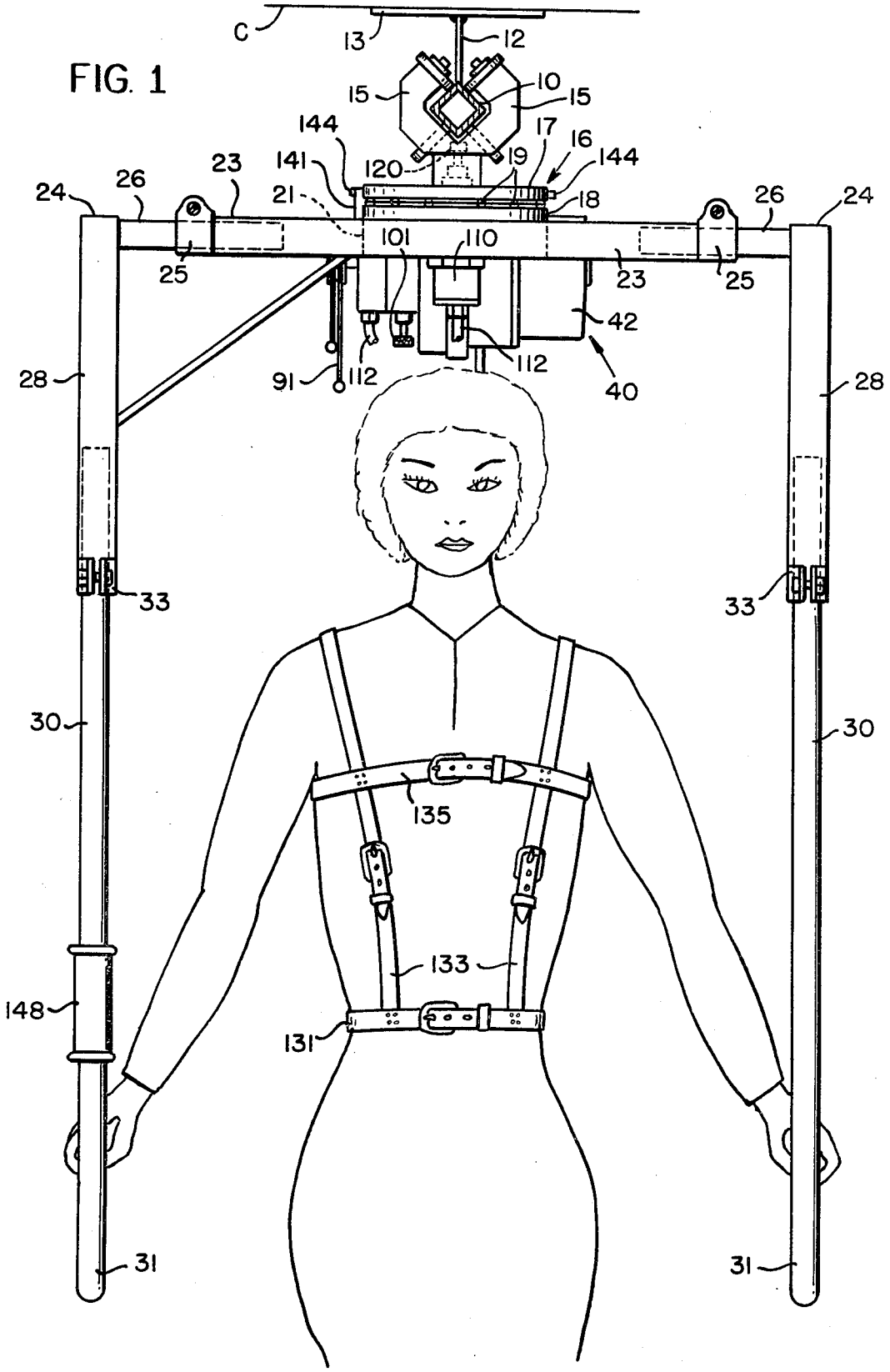
FIG. 1 is a fragmentary front elevational view of a safety restraint mechanism made according to one embodiment of this invention, the mechanism being shown mounted on the overhead ceiling rail which is shown in cross section, and illustrating also the manner in which a patient is adapted to be connnected by a harness to the overhead inertial reel which forms part of this mechanism.
Figure 2:
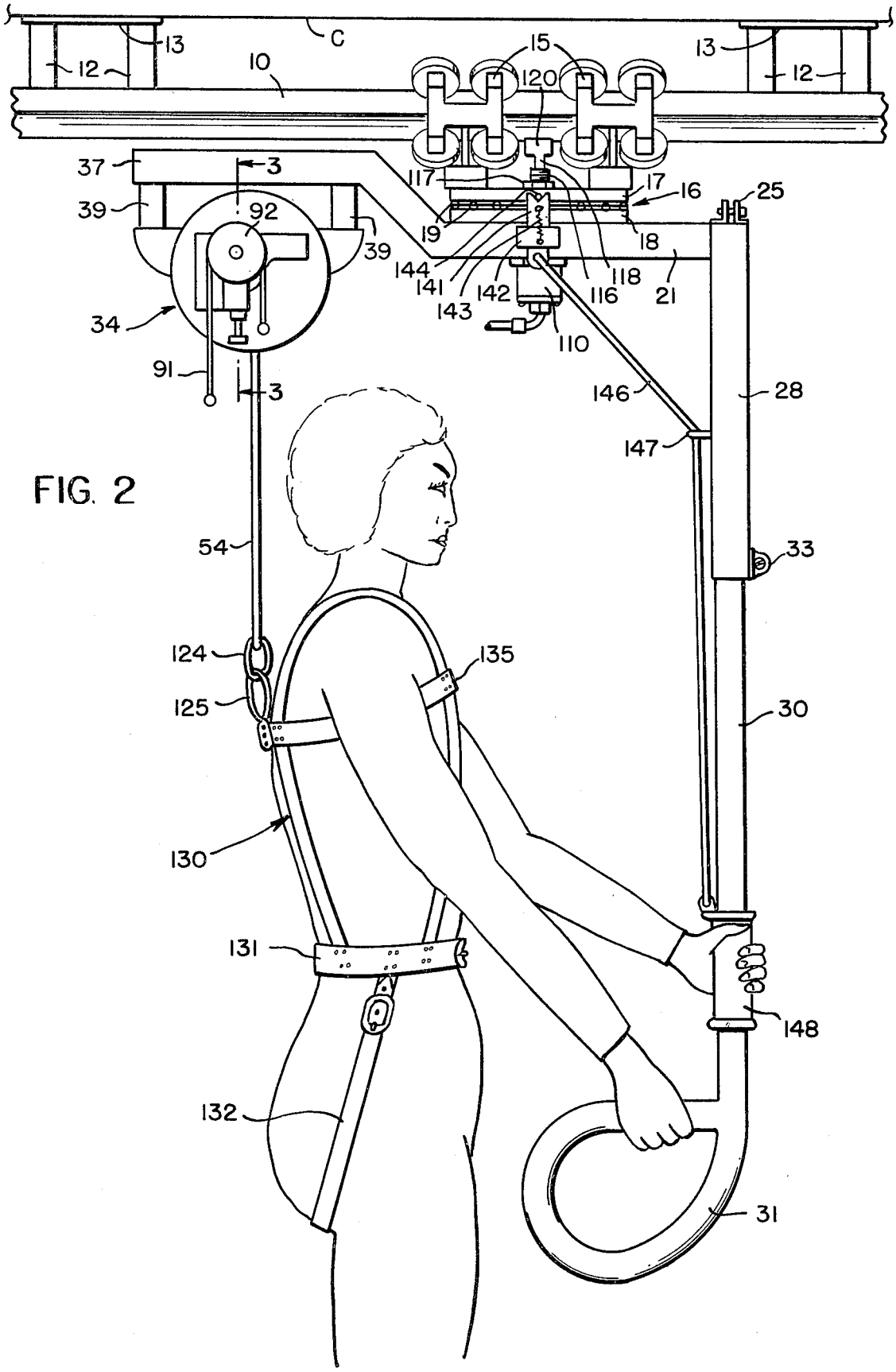
FIG. 2 is a fragmentary side elevation view of this mechanism with a patient again being shown supported in the associated harness.

Referring now to the drawings by numerals of reference, and first to FIGS. 1 and 2, 10 denotes an overhead rail or track, which is generally rectangular in cross section, and which is suspended from the ceiling C of a room by a plurality of plates or brackets 12, which are welded at their lower ends to one of the apices of rail 10, and at their upper ends to a series of plates 13 that are bolted or otherwise secured on ceiling C. Mounted on the undersides of a pair of spaced trucks 15, which are mounted for rolling movement on rail 10, is a conventional, circular, ball bearing housing 16. Bearing housing 16 has an upper race plate 17 fixed to the undersides of the trucks 15, and a lower race plate 18 that is separated from the upper plate 17 by a plurality of ball bearings 19, and which is rotatable relative to plate 17 about a vertical axis through the center of housing 16.

Fastened intermediate its ends to the underside of the rotatable race plate 18 is a rigid platform 21, which has on its forward end (the right end in FIG. 1) a pair of opposed, laterally projecting, tubular extensions 23 that are rectangular in cross section. Each of two right angular brackets 24 has one leg 26 thereof adjustably secured by a conventional clamp 25 in the bore of one of the platform extensions 23. Adjustably and telescopically mounted in the lower end of the other leg 28 of each bracket 24 is the upper end of a rigid, patient-supporting handle 30, each of which has a curved handgrip section 31 on its lower end. The upper end of each handle 30 is adjustably secured in the associated bracket leg 28 by a conventional clamp 33, which may be similar in construction to clamps 25. Platform 21 has a rearwardly extending, vertically offset section 37 (FIG. 2), which carries a pair of spaced posts 39 that project downwardly beneath section 37, and which have fastened to their lower ends an hydraulically operated inertial reel that is denoted generally in the drawings by the numeral 40.

Figure 3:
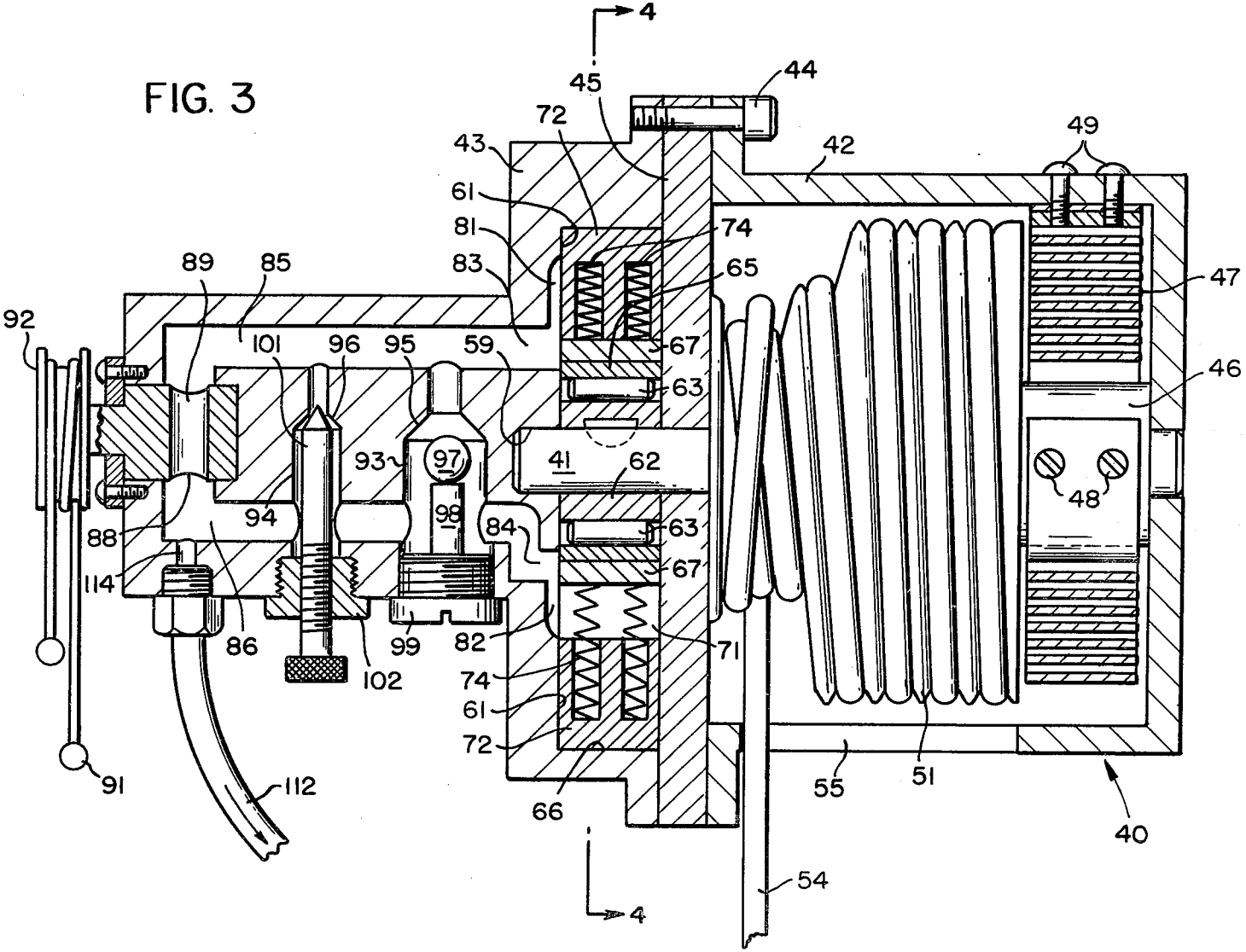
FIG. 3 is an enlarged, fragmentary sectional view taken generally along the line 3—3 in FIG. 2 looking in the direction of the arrows, but with certain of the parts being shown in full.
Figure 4:
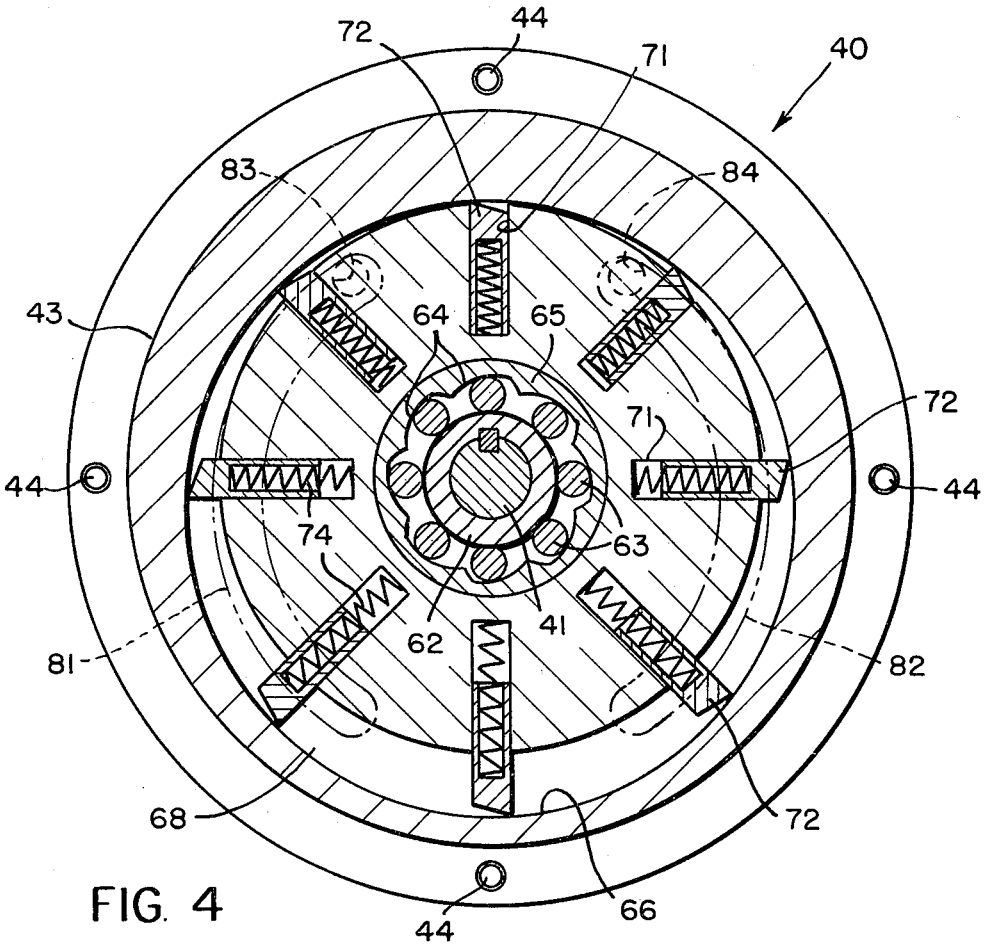
FIG. 4 is a fragmentary sectional view taken generally along the line 4—4 in FIG. 3 looking in the direction of the arrows.

Referring now to FIGS. 3 and 4, reel 40 comprises a shaft 41, which is rotatably journaled at opposite ends in a pair of generally cup-shaped casings or housings 42 and 43, the open ends of which are secured by bolts 44 to opposite sides of a circular spacer plate 45. Adjacent one end (right end in FIG. 3) shaft 41 has thereon an enlarged-diameter portion 46 to which one end of a clock-type return spring or torsion spring 47 is secured by bolts 48. The opposite end of spring 47 is secured as at 49 (FIG. 3) to casing 42 adjacent its closed end, thereby normally to urge shaft 41 to rotate in one direction.

Secured to the shaft 41 between the spacer plate 45 and spring 47 is a frustum-shaped spool or drum 51, which has in its outer peripheral surface a shallow, helical groove 52, which is of progressively decreasing diameter adjacent the left hand end (FIG. 5) of the spool. Secured to the larger end of spool 51, and wound intermediate its ends in the external groove 52 on the spool is a conventional, flexible cord or tether 54, the opposite end of which extends downwardly through an opening 55 (FIG. 3) in the bottom of casing 42.

At its end remote from spring 47 shaft 41 projects rotatably through a central opening in plate 45, and into a blind bore or recess 59 formed in the closed end of housing 43 coaxially thereof. Keyed to shaft 41 for rotation thereby in housing 43 between the spacer plate 45 and a plane surface 61 that is formed on the closed end of the housing, is the hub 62 of a conventional, one-way clutch. The clutch hub 62 is surrounded by a plurality of angularly spaced, axially extending clutch pins 63, which are located between a plurality of angularly spaced teeth 64 (FIG. 4) that are formed on the inner peripheral surface of the outer clutch ring 65. Secured to the clutch ring 65 for rotation in the open end of housing 43 coaxially thereof is an annular pump rotor 67.

As shown more clearly in FIG. 4, the opening in the right end of housing 43 is defined by a counterbore or circular recess having an annular wall 66 the axis of which is slightly offset (downwardly in FIG. 4) from the axial centerline of housing 43 and the pump rotor 67. Also, rotor 67 has a diameter slightly less than the bore wall 66, so that as a consequence the rotor 67 at one point rotates in closely spaced, almost tangential relationship with the annular bore wall 66, while the remainder of the opening in casing 43 defines a nearly crescent-shaped passage 68 (FIG. 4) between the outer peripheral surface of the rotor 67 and the remaining annular wall 66 of the counterbore.

At equi-angularly spaced points around its periphery the rotor 67 has therein radial slots or recesses 71 in each of which a generally rectangular pump vane 72 is mounted for snug, sliding movement radially of the rotor. Each vane 72 is urged radially outwardly in its associated recess by a pair of compression springs 74, each of which seats at one end in a registering recess formed in the bottom of the associated vane 72, and at its opposite end against the bottom of the associated rotor slot 71.

Rotor 67 has on one side a plane surface that overlies a pair of arcuate, shallow recesses or grooves 81 and 82, which are formed in the plane surface 61 at the bottom of the housing bore 66, and adjacent diametrally opposite sides thereof. These two grooves, which are shown in phantom by broken lines in FIG. 4, each communicate adjacent one end (the lower ends in FIG. 4) with passage 68, and at their opposite ends with fluid inlet and outlet ducts 83 and 84, respectively. Duct 83 opens on a low pressure duct 85 that is formed in one side of the closed end of housing 43; and duct 84 opens on a high pressure duct 86 formed in the opposite side of this closed end. Remote from ducts 83 and 84 the ducts 85 and 86 open on the stem of a relief valve 88, which is mounted in the closed end of housing 43 to rotate between an open position in which a port 89 therein connects together adjacent ends of the ducts 85 and 86, and a closed position in which port 89 is rotated 90° from the position shown in FIG. 3 whereby it operatively disconnects adjacent ends of the ducts 85 and 86. By manipulating a cord 91, which is wound about a spool 92 that is secured to the outer end of valve 88, it is possible to rotate the valve between its open and closed positions.

The ducts 85 and 86 are connected by two valve ports 93 and 94, which have intermediate their ends truncated-conical valve seats 95 and 96, respectively (FIG. 3). Port 93 is larger in diameter than port 94, and contains a ball valve 97 that rests upon the stem 98 of an adjusting screw 99, which is adjustably threaded into the closed end of housing 43 coaxially of port 93. The bleeder port 94 contains a pointed needle valve 101, which is adjustably threaded into a bushing 102 in the closed end of housing 42 coaxially of port 93.

Secured to the underside of platform 21 to register with the center of bearing 16 is a conventional hydraulic brake cylinder 110 (FIGS. 1 and 2), one end of which is connected by a hose 112 to a tubular fitting 114 (FIG. 3) secured in the closed end of housing 43 to communicate with duct 86 between the valves 88 and 101. Brake cylinder 110 is secured to platform 21 by a bolt 116, which extends coaxially upwardly through the bearing 16, and which is secured in place by a nut 117 that engages the upper side of the race plate 17. Cylinder 110 operates a plunger 118, which is slidable axially in the bore in bolt 116, and which has on its upper end a brake pad 120 that is adapted releasably to engage the underside of the rail 10 when the brake cylinder is operated, as noted hereinafter.

The end of rope 54 that extends downwardly from the reel 40 is releasably attached by a conventional clasp 124 (FIG. 2) to a ring 125 that is attached to a body support harness denoted generally at 130 in FIGS. 1 and 2. Harness 130 comprises a belt 131, which is attached to opposite ends of a buttocks strap 132, and to opposite ends of a pair of suspender-type shoulder straps 133. Straps 133 can also be interconnected by a shoulder belt 135 which carries ring 125. Obviously other types of harnesses may be employed provided they have some easy means of attachment to cord 54.

Platform 21 normally is secured against rotation by a spring-loaded detent 141, which slides beneath a plate 142 that is fastened to one side of platform 21. A spring 143 (FIG. 2) urges plate 141 upwardly to engage a notch in the upper end thereof with one or two stop pins 144, which project from diametrally opposite sides of the race plate 17. The lower end of detent 141 is attached to one end or a cord 146, the opposite end of which passes slidably through a guide ring 147 on one of the bracket legs 28 and downwardly to a patient-controlled sleeve 148, which is slidably mounted on one of the handles 30.

In use the reel 40 is filled with a hydraulic fluid which substantially fills the passage 68, ducts 85 and 86, and the brake cylinder 110. Assuming that the pump rotor 67 is no being rotated, no pressure will be applied to the fluid, and as a consequence the brake pad 120 will not be engaged with the underside of rail 10. The handles 30 are then adjusted vertically and laterally so that their hand grip sections 31 will be suitably positioned for a patient. Assuming that the patient is wearing a harness 130, the cord 54 is then attached by clasp 124 to the harness ring 125; and spring 47 then tends to keep the cord 54 taut. Before the patient begins to walk he or she should make sure that the pressure release control valve 88 is in its closed position (opposite to that illustrated in FIG. 3). The patient may then grip the handles 31 and begin to walk.

If while walking the patient should suddenly fall or collapse, the cord 54 will be drawn first off of the smaller end of the spool 51 as shown in FIG. 3, and will thereby tend to rotate the spool and the attached shaft 41 very rapidly, for example in a counterclockwise direction as shown in FIG. 4. This rotation is transmitted through the cutch 62–64 to the pump rotor 67, which is likewise caused to rotate counterclockwise. During this rotation of the rotor the springs 74 cause the outer ends of the vanes 72 to be held resiliently and in sliding, wiping engagement with the annular bore wall 66. Consequently, the hydraulic fluid in passage 68 is swept in a counterclockwise direction, thus causing fluid to be drawn through the inlet port 83 and groove 81 to passage 68, and to be forced counterclockwise into the outlet groove 82 and eventually through the outlet port 84 into the high pressure duct 86.

Normally at this time valve 88 will be closed, so that fluid entering duct 86 will tend to pass simultaneously through ducts 93 and 94 to the return or low pressure duct 85, and through hose 112 to the brake cylinder 110, thereby to apply the brake pad 120 to the underside of rail 10. If the withdrawal rate of the cord 54 is below the rate for which the ball valve 97 in duct 93 has been designed to close, most of the hydraulic fluid will continue to flow through duct 93 to the inlet port 83 at a rate which will somewhat retard withdrawal of the cord 54, and yet will permit the attached patient to make reasonably normal moves.

Obviously the greater the speed at which the cord 54 is withdrawn from reel 40, the greater will be the rate of rotation of the rotor 67, and consequent velocity of the fluid through duct 93. Whenever the cord 54 is withdrawn at the rate great enough to cause the velocity of the fluid passing through the duct 93 to force the ball valve 97 into a closed position against the annular valve seat 95, any further withdrawal of the cord will be controlled by the flow of fluid through the adjacent bleeder duct 94. Obviously this causes the rate of withdrawal of the cord 54 to be slowed considerably, whereby the patient is lowered slowly to the floor after his or her initial stumble has caused valve 97 to close. It will also be apparent that the rate of flow fluid through bleeder duct 94 can be controlled merely by adjusting the needle valve 101.

As previously noted, the hydraulic fluid system operates the brake cylinder 110 each time that the rotor 67 is suddenly rotated in its counterclockwise direction. Obviously the greater the pressure generated by the rotor 67 the greater will be the braking force supplied by the pad 120 to the rail 10. The advantage of this mechanism is that its brakes the trucks 15 whenever the patient suddenly stumbles or falls, so that the torsion reel 40 will remain directly above the patient.

Figure 5:
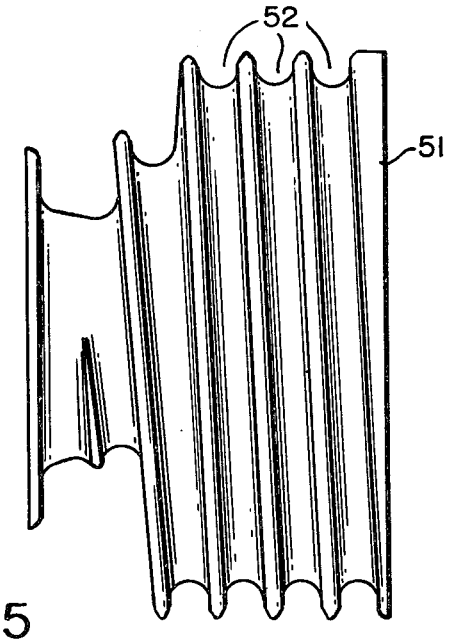
FIG. 5 is a side elevational detail view of the tether spool which forms part of the improved hydraulic inertial reel used in this mechanism.

Although it is desirable initially to brake the withdrawal of the cord 54 from housing 42 when a patient first stumbles, once the patient's knees and/or hands have engaged the floor, it is no longer necessary to generate such a large restraining force in the cord 54. For this reason the spool 51 is designed so that during the initial downward movement of a patient's body the cord is unwound from the frustum or cone shaped end of the spool, thereby causing the pump rotor 67 to be rotated at a relatively high RPM. However, by the time the patient's knees and/or hands have engaged the floor the cord 54 will have been withdrawn far enough to uncover the smaller end of the spool 51, so that any further withdrawal of the cord will be made from the larger end of the spool, which in FIG. 5 is the right hand end of the spool where the three adjacent grooves 52 are substantially equal in diameter. At this stage, therefore, the rate of rotation of rotor 67 is slowed down somewhat, so that the corresponding restraint experienced by the patient would be slightly less than that encountered during the initial withdrawal of the cord from the housing.

Whenever a patient rises to a normal standing position, as shown for example in FIGS. 1 and 2, the tension in spring 47 causes the spool 51 to be rotated in a direction (for example clockwise in FIG. 4) to cause the cord 54 to be rewound onto the spool, beginning for example from the right end of the reel as shown in FIG. 3 and winding toward the left end thereof. During this retraction of the cord the rotor 67 remains stationary, because the one-way clutch 62–64 permits the shaft 41 to be rotated, (for example in the above-noted clockwise direction) without imparting any corresponding rotation to rotor 67.

To reverse the direction in which he or she is walking, a patient need only to draw downwardly on the sleeve 148 to apply enough tension to the cord 146 to draw the detent 140 downwardly far enough to disengage its upper end from the pin 144 as shown in FIG. 2. The patient may then rotate the entire platform 21 one hundred eighty degrees relative to the position as shown in FIG. 2, at which time the patient can then release sleeve 148 to permit spring 143 to re-engage the upper end of detent 141 with the pin 144 which is diametrally opposite the one shown in FIG. 2. The patient is now facing in the opposite direction, and the platform 21 is once again locked against vertical rotation relative to race plate 17.

Whenever the patient wishes to sit down or otherwise to disengage the hydraulic restraint system from the spring-loaded spool 51, he or she need only to pull on the cord 91 in a direction to rotate valve 90° from its closed position, thereby to place the valve in its open position as shown for example in FIG. 3. This permits the fluid freely to circulate in the system through the inlet port 84, duct 86, the port 89 in valve 88 and the return duct 85 to the inlet port 83. This removes from the cord 54 most of the restraining effect apart from that caused by the return spring 47.

From the foregoing it will be apparent that the improved restraining system disclosed herein provides the associated patient with greater stability and control over the restraint mechanism to which she or he is attached. The handles 30 provide the benefit equivalent to the conventional hand-operated walkers, which are so frequently employed by ambulatory patients, since the attached patient is free to grip and lean on the handles 30 as may be necessary. This new system, moreover, has the additional feature that, even if the patient is unable to maintain his or her balance while using the handles 30, any sudden fall of the patient will be restrained by virtue of the hydraulically operated inertial reel 40, thus precluding any injury which might otherwise result when a patient falls or stumbles.

Another advantage of this system is that the patient can control the operation of the hydraulic system merely by manipulating the cord 91 which controls the relief valve 89. Moreover the adjustable needle valve 101 is located just above the patient's head so that it can be easily adjusted by the patient if need be. Moreover, it is but a simple matter for the patient to pull downwardly on the sleeve 148 in order to reverse direction of the motion of the restraint mechanism.

Among the automatic features introduced by this system is the braking of the trucks 15 whenever the patient stumbles. This assures, in essence, that the patient will be lowered directly downwardly, rather than being permitted to fall backwardly or forwardly during a fall, and possibly striking an obstruction with his or her head. Likewise, the specially shaped spool 51 permits the greatest restraint to be applied during the initial withdrawal of cord 54, followed by a somewhat lesser restraining force after the patient's knees and/or hands have engaged the floor. Moreover, the one-way clutch enables the hydraulic system to be pressurized only upon rotation of the pump rotor 67 in one direction-,—i.e. the direction in which the cord 54 is unwound from housing 42. When the cord 54 is rewound into the housing the hydraulic fluid system does not interfere with the retraction of the cord by the return spring 47. This makes the system extremely responsive to the movements of an attached patient, and also affords a patient greater mobility as compared, for example, to prior such systems.

It will be apparent that the trucks 15 could be attached to the rail 10 in such manner as to permit the trucks to rotate slightly relative to one another, for example about the points where the trucks are attached to the upper race plate 17. This would enable the rail 10 to be curved or otherwise designed to provide a path of travel other than in a straight, linear path. Likewise, while specific valves have been disclosed for controlling the flow of fluid in housing 43, it will be apparent that equivalent valves could be employed if desired. However, it is important to design duct 93 so that the ball valve 97 will be closed whenever velocity of the hydraulic fluid passing through the duct exceeds a predetermined velocity. The advantage of the use of ball valve 97 is that it is readily adjustable by the associated head 99, and generally minimizes turbulence during the flow of fluid through duct 93. Obviously, if desired, a resilient spring of modest rating could be employed to assist gravity in retaining spring 97 in its open position as shown in FIG. 3.

While this system has been described in detail in connection with only certain embodiments thereof, it will be apparent that it is capable of still further modification, and that this application is intended to cover any such modifications as may fall within the scope of one skilled in the art or the appended claims.

What we claim is:

1. In a safety restraint system having an overhead rail, an inertial reel mounted on said rail, and a retractable, patient-supporting cord wound at one end on a rotatable spool in said reel and disposed to be connected at its opposite end to an ambulatory patient, the improvement comprising means connecting said inertial reel to said rail for movement longitudinally thereof, and for rotational adjustment relative thereto about a vertical axis, and means for releasably securing said reel against rotation relative to said rail, and selectively in one of at least two different operating positions angularly spaced approximately 180° from each other about said vertical axis.

2. A system as defined in claim 1, including means for automatically braking said reel against longitudinal movement relative to said rail when said cord is withdrawn suddenly from said reel.

3. A system as defined in claim 1, including first means for resisting rotation of said spool in one direction, thereby to resist withdrawal of said cord from said reel, and second means operable automatically to increase the resistance to the rotation of said spool when the rate of rotation thereof in said one direction exceeds a predetermined value.

4. A system as defined in claim 3, including manually operable means for selectively interrupting the operation of said second means.

5. A system as defined in claim 3, including means for automatically preventing operation of said second means when said spool is rotated in the opposite direction.

6. A system as defined in claim 1, wherein said connecting means comprises truck means mounted to roll on said rail and having thereon a platform rotatably adjustable about said vertical axis, said reel is mounted on said platform for rotational adjustment thereby between said two operating positions thereof, and rigid support means projects downwardly from said platform in position to be gripped by the patient attached to said cord.

7. A system as defined in claim 6, wherein said support means comprises a pair of handles mounted for lateral and vertical adjustment, respectively, relative to said platform, and said means for releasably securing said reel against rotation includes means movably mounted on one of said handles for operation by a patient selectively to release said platform for rotation about said vertical axis.

8. A system as defined in claim 1, including a pump housing containing a rotatable impeller for circulating a fluid under pressure in said housing, means connecting said impeller to said spool for rotation thereby in one direction when said cord is withdrawn from said reel, and means controlling the circulation of fluid in said housing so that the resistance to the withdrawal of said cord increases with the rate of rotation of said impeller in said one direction.

9. A system as defined in claim 8, wherein said cord is wound in a helical groove formed in the outer periphery of said spool, and is guided by said groove to unwind progressively from one end of the spool toward the other when the cord is withdrawn from the reel; and the diameter of said groove increases progressively from a minimum value adjacent said one end of the spool to a maximum value at a point intermediate the ends of said spool.

10. A system as defined in claim 8, wherein said means controlling the circulation of said fluid comprises first valve means for throttling the flow of fluid in said pump housing to increase the resistance to the withdrawal of said cord, and second, manually-operable valve means movable between a first position in which it operatively shunts said first valve means, and a second position in which it causes fluid in said housing to be circulated through said first valve means.

11. A system as defined in claim 10, wherein said first valve means comprises a first valve port having mounted therein a ball valve disposed to be moved to a closed position when the rate of flow of said fluid through said first port exceeds a predetermined value, and a second valve port mounted in parallel with said first valve port and having therein an adjustable needle valve for controlling the rate of flow of fluid in said housing when said ball valve is closed.

* * * * *